US010855016B2

(12) United States Patent
Dai

(10) Patent No.: US 10,855,016 B2
(45) Date of Patent: Dec. 1, 2020

(54) TERMINAL SET AND ELECTRICAL CONNECTOR

(71) Applicant: LOTES CO., LTD, Keelung (TW)

(72) Inventor: Yong Jun Dai, Keelung (TW)

(73) Assignee: LOTES CO., LTD., Keelung (TW)

( * ) Notice: Subject to any disclaimer, the term of this patent is extended or adjusted under 35 U.S.C. 154(b) by 0 days.

(21) Appl. No.: 16/745,630

(22) Filed: Jan. 17, 2020

(65) Prior Publication Data

US 2020/0251843 A1 Aug. 6, 2020

(30) Foreign Application Priority Data

Feb. 1, 2019 (CN) ..... 2019 1 0105073

(51) Int. Cl.

| | |
|---|---|
| ***H01R 13/24*** | (2006.01) |
| ***H01R 13/50*** | (2006.01) |
| ***H01R 4/02*** | (2006.01) |
| ***H01R 12/58*** | (2011.01) |

(52) U.S. Cl.

CPC ..... *H01R 13/24* (2013.01); *H01R 13/50* (2013.01); *H01R 4/029* (2013.01); *H01R 12/58* (2013.01)

(58) Field of Classification Search

CPC .. H01R 23/722; H01R 9/096; H01R 13/2442; H01R 13/24; H01R 13/50

USPC ..... 439/862, 66

See application file for complete search history.

(56) References Cited

U.S. PATENT DOCUMENTS

| | | | | |
|---|---|---|---|---|
| 1,477,527 | A * | 12/1923 | Raettig | H01H 1/42 200/282 |
| 6,645,012 | B2 * | 11/2003 | Ito | H01R 12/721 439/637 |
| 6,688,893 | B1 * | 2/2004 | Huang | H01R 12/57 439/66 |
| 7,479,015 | B2 * | 1/2009 | Ruttan | H05K 7/1069 439/66 |
| 9,039,461 | B2 * | 5/2015 | Wan | H01R 13/04 439/733.1 |

(Continued)

FOREIGN PATENT DOCUMENTS

| | | | |
|---|---|---|---|
| CN | 201352624 | Y | 11/2009 |
| CN | 204391314 | U | 6/2015 |

(Continued)

*Primary Examiner* — Gary F Paumen

(74) *Attorney, Agent, or Firm* — Locke Lord LLP; Tim Tingkang Xia, Esq.

(57) ABSTRACT

A terminal set and an electrical connector are provided. The terminal set includes a first terminal and a second terminal. The first terminal has a first base, a first elastic portion extending upward from the first base, and a first contact portion extending backward from the first elastic portion. The second terminal has a second base, a second elastic portion extending upward from the second base, and a second contact portion extending backward from the second elastic portion. The second elastic portion is located in front of the first elastic portion and overlaps with the first elastic portion in a front-rear direction, and the second contact portion does not overlapped with the first elastic portion in an vertical direction, thereby enhancing the density of the terminal set, and increasing contact points of the terminal set in contact with a mating component in a limited space.

16 Claims, 9 Drawing Sheets

(56) References Cited

U.S. PATENT DOCUMENTS

| | | | | |
|---|---|---|---|---|
| 2004/0185722 | A1* | 9/2004 | Conrad | H01R 12/7088 439/857 |
| 2005/0020099 | A1* | 1/2005 | Brown | H01R 13/2442 439/71 |
| 2005/0020146 | A1* | 1/2005 | McAlonis | H01R 13/2492 439/862 |
| 2007/0032136 | A1* | 2/2007 | Sheng | H01R 31/06 439/630 |
| 2009/0047817 | A1* | 2/2009 | Liu | H01R 13/2492 439/296 |
| 2011/0212649 | A1* | 9/2011 | Stokoe | H01R 12/721 439/626 |
| 2014/0170912 | A1* | 6/2014 | Ando | H01R 13/113 439/862 |

FOREIGN PATENT DOCUMENTS

| | | | |
|---|---|---|---|
| CN | 107240798 | A | 10/2017 |
| CN | 206610934 | U | 11/2017 |
| CN | 207442024 | U | 6/2018 |
| TW | M344660 | U | 11/2008 |

* cited by examiner

A-A

TERMINAL SET AND ELECTRICAL CONNECTOR

CROSS-REFERENCE TO RELATED PATENT APPLICATION

This non-provisional application claims priority to and the benefit of, pursuant to 35 U.S.C. § 119(a), patent application Serial No. CN201910105073.X filed in China on Feb. 1, 2019. The disclosures of the above applications are incorporated herein in their entireties by reference.

Some references, which may include patents, patent applications and various publications, are cited and discussed in the description of this disclosure. The citation and/or discussion of such references is provided merely to clarify the description of the present disclosure and is not an admission that any such reference is "prior art" to the disclosure described herein. All references cited and discussed in this specification are incorporated herein by reference in their entireties and to the same extent as if each reference were individually incorporated by reference.

FIELD

The present invention relates to a terminal set and an electrical connector, and more particularly to a terminal set for enhancing terminal arrangement density and an electrical connector using the terminal set.

BACKGROUND

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

The terminals of an electrical connector are used for electrically connecting a mating component to a circuit board. The terminals include a first conductive terminal and a second conductive terminal separate from each other. The first conductive terminal includes a base assembled to the second conductive terminal, and a first elastic portion bending and extending upward from the base. A tail end of the first elastic portion is provided with a bending first contact portion in contact with the mating component. The second conductive terminal includes a retaining portion which is flat plate shaped, a second elastic portion extending obliquely upward from one end of the retaining portion, and a soldering portion bending and extending downward from the other end of the retaining portion. A tail end of the second elastic portion is provided with a bending second contact portion in contact with the mating component. The second contact portion is located above the first elastic portion, and the first contact portion overlaps with the second elastic portion in a vertical direction. However, when the mating component presses downward on the first contact portion and the second contact portion, the first contact portion moves downward. Since the first contact portion is located directly above the second elastic portion, the first contact portion easily contacts the second elastic portion, causing the second elastic portion to limit the movement of the first contact portion, thereby affecting the contact effect between the first contact portion and the mating component, and affecting the performance of the terminals.

Therefore, a heretofore unaddressed need to design a terminal set and an electrical connector exists in the art to address the aforementioned deficiencies and inadequacies.

SUMMARY

The present invention is directed to a terminal set and an electrical connector for enhancing terminal arrangement density, while ensuring good contact between the terminals and a mating component.

To achieve the foregoing objective, the terminal set according to certain embodiments of the present invention adopts the following technical solutions.

A terminal set is configured to be electrically connected to a mating component, and includes: a first terminal, having a first base, a plurality of first elastic portions extending upward from the first base and arranged in a row in a left-right direction, and a first contact portion extending backward from the first elastic portions; and a second terminal formed separately from the first terminal, wherein the first terminal and the second terminal are electrically connected to each other, the second terminal has a second base located in front of the first base, a plurality of second elastic portions extending upward from the second base and arranged in a row in the left-right direction, a second contact portion extending backward from the second elastic portions and located in front of the first contact portion, and the first contact portion and the second contact portion are configured to upward abut the mating component; wherein the second contact portion is located between two adjacent ones of the first elastic portions in a vertical direction; and the second elastic portions shield at least a portion of the corresponding first elastic portions backward in a front-rear direction.

In certain embodiments, the second elastic portions shield a portion of the corresponding first elastic portions downward in the vertical direction.

In certain embodiments, each of the first elastic portions has a first shielding portion and a first extending portion protruding from the first shielding portion in a width direction, each of the second elastic portions has a second shielding portion and a second extending portion protruding from the second shielding portion in the width direction, the second shielding portion shields the first shielding portion backward in the front-rear direction, the second extending portion is located between the two adjacent ones of the first elastic portions, and the first extending portion is located between two adjacent ones of the second elastic portions.

In certain embodiments, the first contact portion forms a first notch at a side close to the first shielding portion, the first notch extends forward to the first shielding portion, the second contact portion forms a second notch at a side close to the second shielding portion, and the second notch extends forward to the second shielding portion.

In certain embodiments, one side of the first extending portion is flush with one side of the first contact portion.

In certain embodiments, the terminal set further includes a metal plate, wherein the first terminal and the second terminal are both power terminals, an electrical conductivity of the metal plate is higher than electrical conductivities of the first terminal and the second terminal, and the first base and the second base are fixed to a front side and a rear side of the metal plate.

In certain embodiments, the second contact portion extends downward to form a free portion, and the free portion is provided to overlap with a corresponding one of the first elastic portions in the left-right direction.

To achieve the foregoing objective, the electrical connector according to certain embodiments of the present invention adopts the following technical solutions.

An electrical connector includes: an insulating body; a rear terminal, accommodated in the insulating body, wherein the rear terminal has a rear base, at least one rear elastic portion extending upward from the rear base, and a rear contact portion extending backward from the rear elastic portion; and a front terminal, accommodated in the insulating body and separately formed from the rear terminal, wherein the front terminal has a front base located in front of the rear base, at least one front elastic portion extending upward from the front base, and a front contact portion extending backward from the front elastic portion and located in front of the rear contact portion, and the front contact portion and the rear contact portion are configured to upward abut a mating component; wherein the front elastic portion and the rear elastic portion are provided to be at least partially overlapped in a front-rear direction, and the front contact portion does not overlap with the rear elastic portion in a vertical direction.

In certain embodiments, the front elastic portion has a shielding portion and an extending portion protruding from the shielding portion in a width direction, the shielding portion overlaps with the rear elastic portion in the front-rear direction, and the extending portion does not overlap with the rear elastic portion in the front-rear direction.

In certain embodiments, the front contact portion forms a notch at a side close to the shielding portion, and the notch extends forward to the shielding portion.

In certain embodiments, the insulating body is provided with a plurality of accommodating holes running vertically through the insulating body, and the front terminal and the rear terminal are accommodated in two of the accommodating holes spaced apart and are not electrically connected to each other.

In certain embodiments, the insulating body is provided with an accommodating hole running vertically through the insulating body, and the front terminal and the rear terminal are accommodated in the same accommodating hole and are electrically connected to each other.

In certain embodiments, the front base and the rear base accommodated in the same accommodating hole are fixed to a front side and a rear side of a metal plate, the front terminal and the rear terminal are both power terminals, and an electrical conductivity of the metal plate is higher than electrical conductivities of the front terminal and the rear terminal.

In certain embodiments, the two of the accommodating holes accommodate two metal plates, one of the two metal plates fixes the front terminal, the other of the two metal plates fixes the rear terminal, each of the metal plates has an insertion portion, and the insertion portions of the two metal plates are staggered in the front-rear direction.

In certain embodiments, the front elastic portion shields a portion of the rear elastic portion downward in the vertical direction.

In certain embodiments, the front contact portion extends downward to form a free portion, and the free portion is provided to overlap with the corresponding rear elastic portion in a left-right direction.

Compared with the related art, certain embodiments of the present invention have the following beneficial effects.

The first elastic portion of the first terminal and the second elastic portion of the second terminal at least partially overlap in the front-rear direction. Compared to the case where the first elastic portion and the second elastic portion are staggered in the front-rear direction, the distance between the first elastic portion and the second elastic portion in the left-right direction can be reduced. Meanwhile, the second contact portion is located between the adjacent two first elastic portions in the vertical direction. Thus, the second contact portion does not overlap with the first elastic portion in the vertical direction, thereby preventing the second contact portion from abutting the first elastic portion downward when the mating component presses downward on the second contact portion, and ensuring good contact between the mating component and the second contact portion. Meanwhile, the distance between the first terminal and the second terminal in the front-rear direction can be reduced, thereby enhancing the density of the terminal set, and increasing contact points of the terminal set in contact with the mating component in a limited space.

These and other aspects of the present invention will become apparent from the following description of the preferred embodiment taken in conjunction with the following drawings, although variations and modifications therein may be effected without departing from the spirit and scope of the novel concepts of the disclosure.

BRIEF DESCRIPTION OF THE DRAWINGS

The accompanying drawings illustrate one or more embodiments of the disclosure and together with the written description, serve to explain the principles of the disclosure. Wherever possible, the same reference numbers are used throughout the drawings to refer to the same or like elements of an embodiment, and wherein.

DETAILED DESCRIPTION

Figure 1:
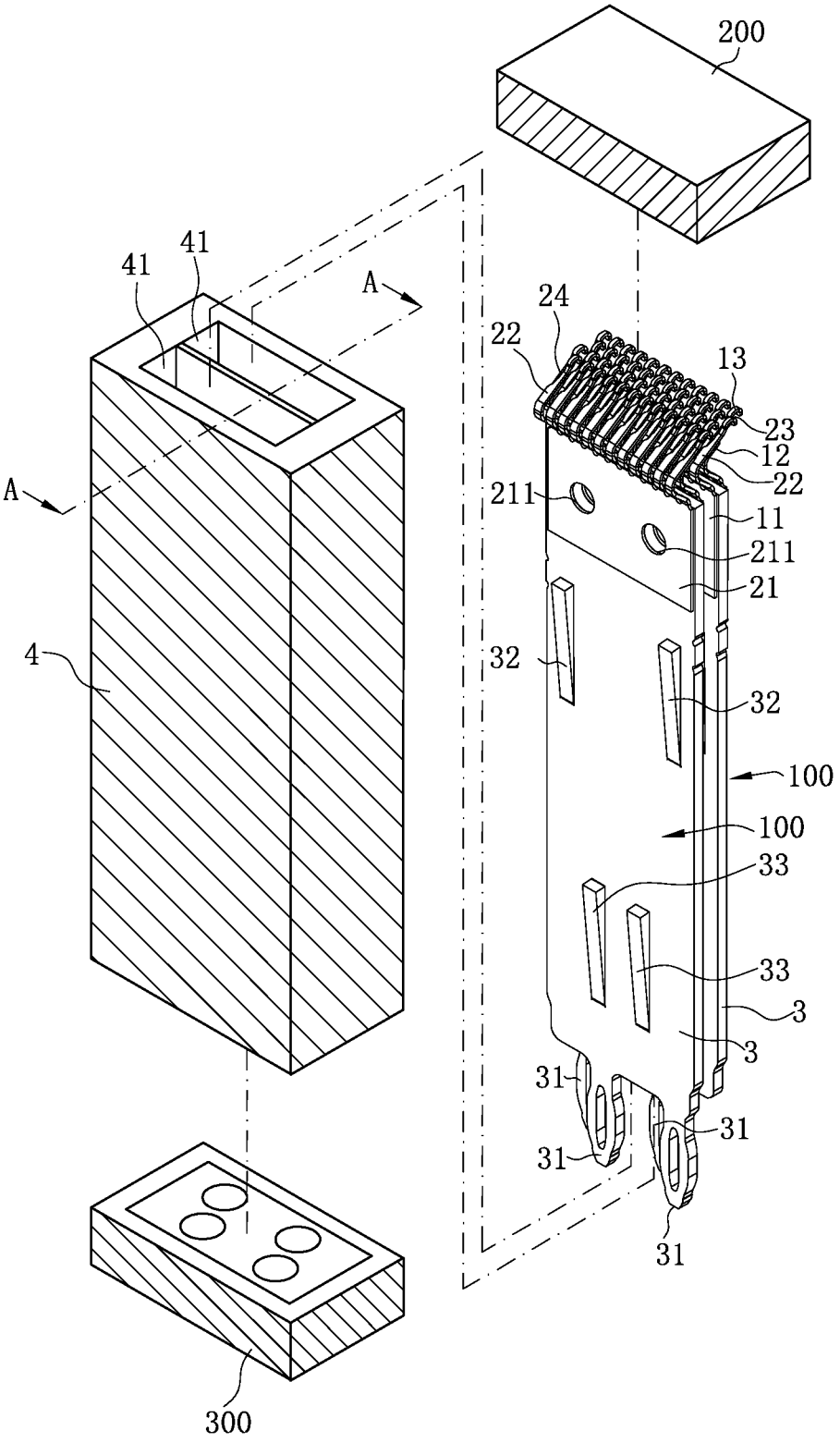
FIG. 1 is a perspective exploded view of an electrical connector according to certain embodiments of the present invention.

The present invention is more particularly described in the following examples that are intended as illustrative only since numerous modifications and variations therein will be apparent to those skilled in the art. Various embodiments of the invention are now described in detail. Referring to the drawings, like numbers indicate like components throughout the views. As used in the description herein and throughout the claims that follow, the meaning of "a", "an", and "the" includes plural reference unless the context clearly dictates otherwise. Also, as used in the description herein and throughout the claims that follow, the meaning of "in" includes "in" and "on" unless the context clearly dictates otherwise. Moreover, titles or subtitles may be used in the specification for the convenience of a reader, which shall have no influence on the scope of the present invention.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower", can therefore, encompasses both an orientation of "lower" and "upper," depending of the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

As used herein, "around", "about" or "approximately" shall generally mean within 20 percent, preferably within 10 percent, and more preferably within 5 percent of a given value or range. Numerical quantities given herein are approximate, meaning that the term "around", "about" or "approximately" can be inferred if not expressly stated.

As used herein, the terms "comprising", "including", "carrying", "having", "containing", "involving", and the like are to be understood to be open-ended, i.e., to mean including but not limited to.

The description will be made as to the embodiments of the present invention in conjunction with the accompanying drawings in FIGS. 1-9. In accordance with the purposes of this invention, as embodied and broadly described herein, this invention, in one aspect, relates to a terminal set and an electrical connector.

FIG. 1 to FIG. 9 show an electrical connector according to an embodiment of the present invention, which is used for electrically connecting a mating component 200 to a circuit board 300. The electrical connector has an insulating body 4 and a plurality of terminal sets 100 accommodated in the insulating body 4. The quantity of the terminal sets 100 may be one, two, three or even more (only two terminal sets 100 are shown in FIG. 1 to FIG. 9). Each terminal set 100 includes a metal plate 3, and a first terminal 1 and a second terminal 2 fixed at two opposite sides of the metal plate 3. The first terminal 1, the second terminal 2 and the metal plate 3 are separately formed, and are in contact with one another and electrically connected to each other. In other embodiments, it may be that no metal plate 3 is provided, and the first terminal 1 and the second terminal 2 are assembled together, and are in contact with each other and electrically connected to each other.

Figure 8:
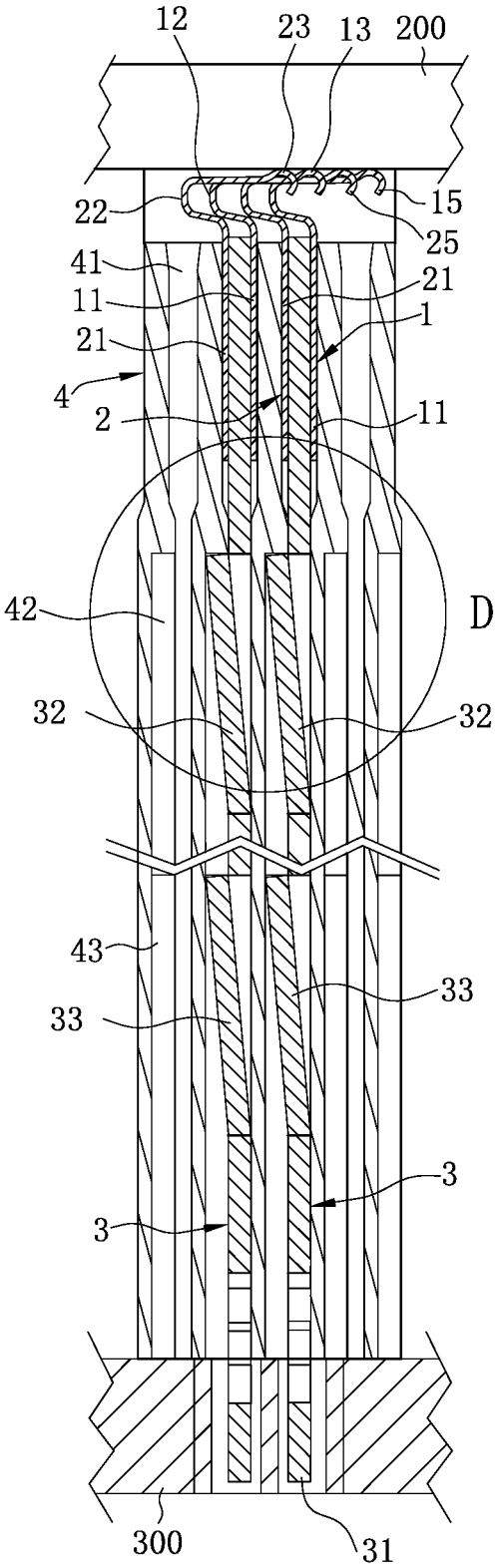
FIG. 8 is a sectional view of FIG. 1 along line A-A.

As shown in FIG. 1 and FIG. 8, the insulating body 4 is provided with a plurality of accommodating holes 41 running therethrough vertically to accommodate the terminal sets 100. A pair of first position limiting slots 42 and a pair of second position limiting slots 43 are provided on a same side wall of each accommodating hole 41, and the first position limiting slots 42 are located above the second position limiting slots 43.

Figure 2:
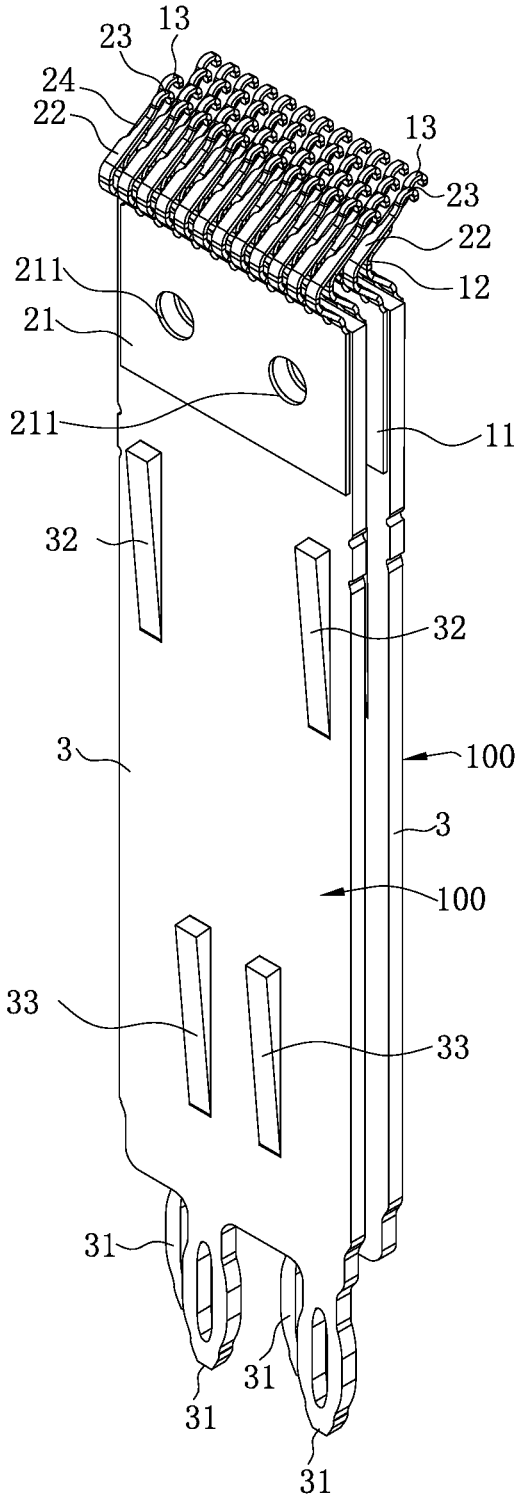
FIG. 2 is a perspective view of two terminal sets according to certain embodiments of the present invention.
Figure 3:
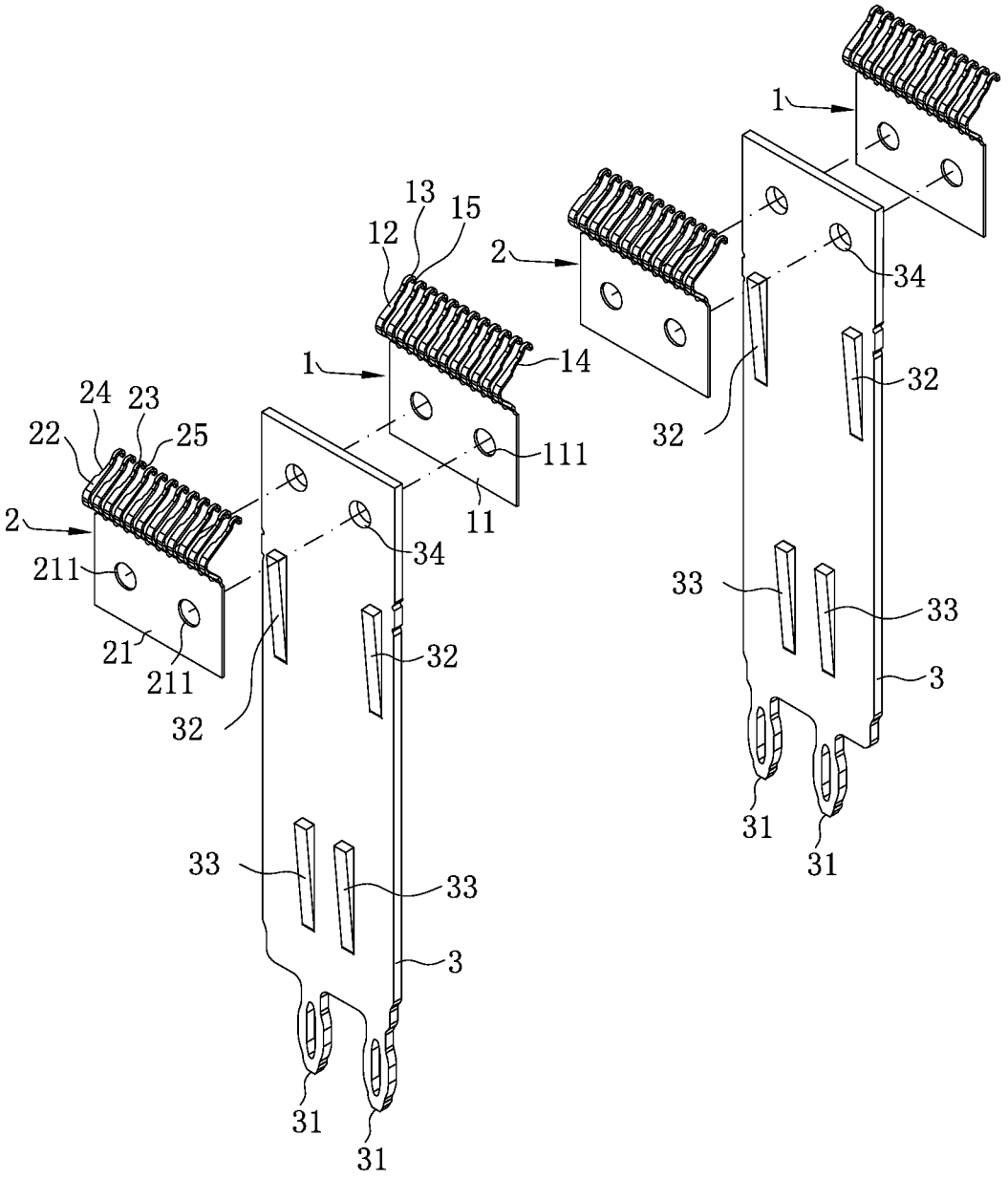
FIG. 3 is an exploded view of FIG. 2.
Figure 4:
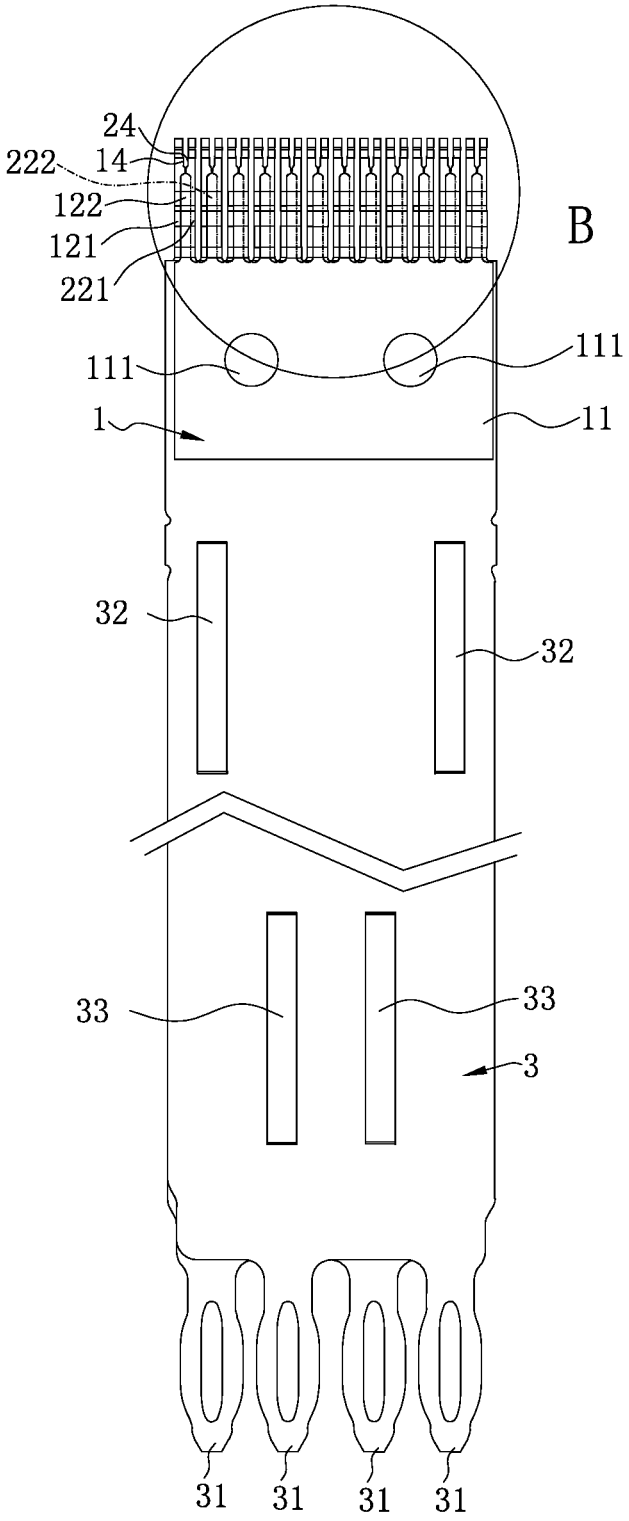
FIG. 4 is a front view of FIG. 2.
Figure 5:
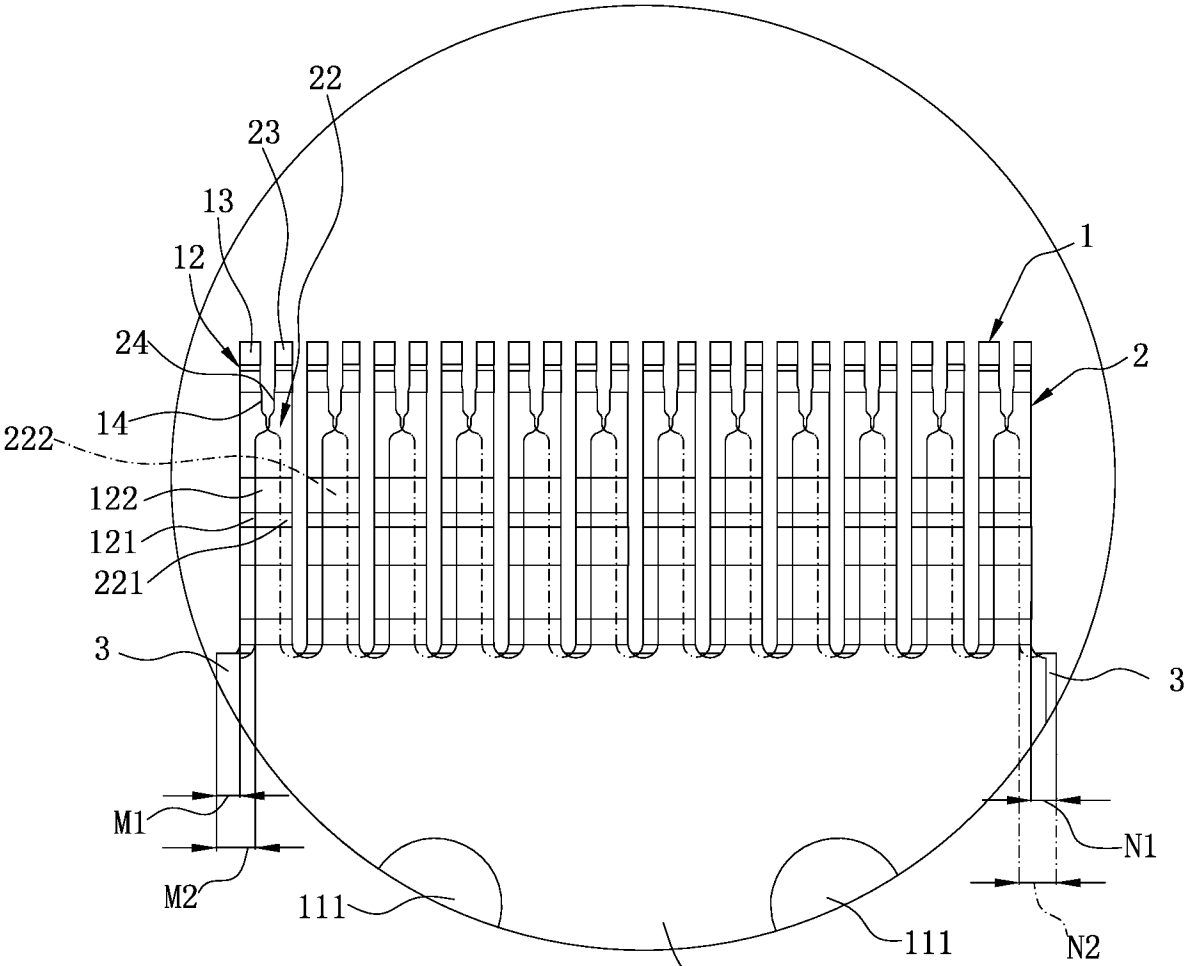
FIG. 5 is an enlarged view of a part B of FIG. 4.
Figure 6:
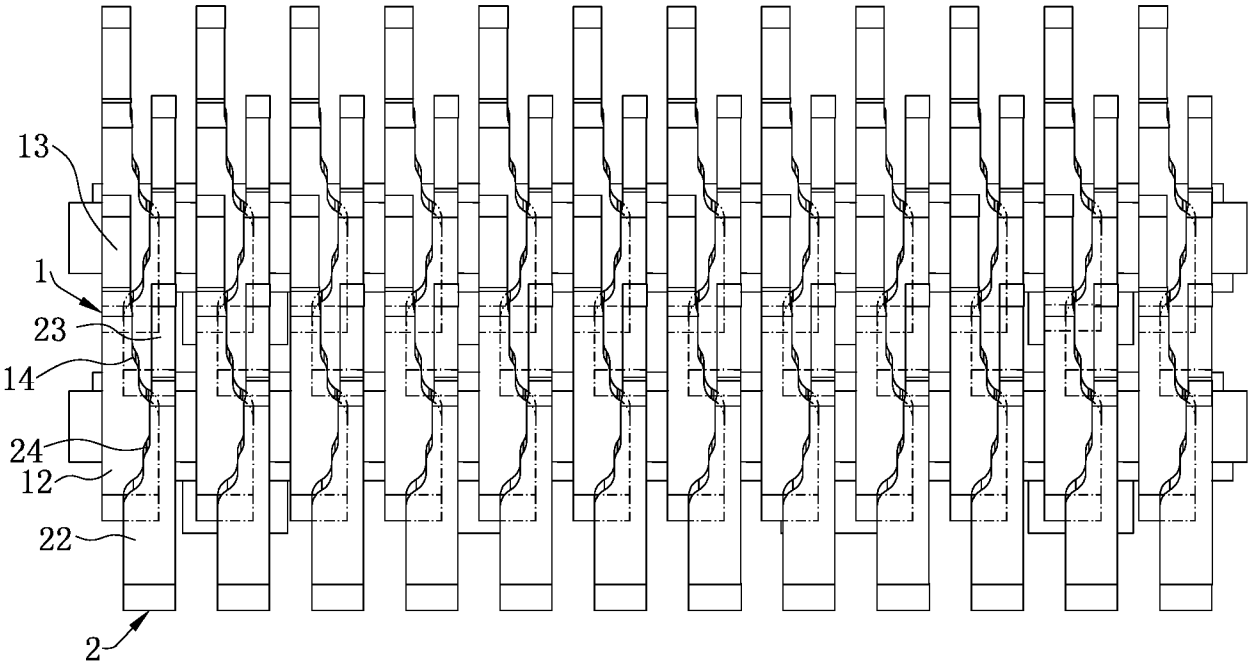
FIG. 6 is a top view of FIG. 2.

As shown in FIG. 2, FIG. 3 and FIG. 8, the first terminal 1 has a first base 11 attached to a rear side of the metal plate 3. The first base 11 is in a substantially flat plate shape. The first base 11 is provided with two first positioning holes 111 running therethrough in a front-rear direction. Multiple first elastic portions 12 bend and extend upward from the first base 11 and are arranged in a row in a left-right direction. In other embodiments, the first terminal 1 may also be provided with only one first elastic portion 12. Specifically, each first elastic portion 12 bends and extends forward from the first base 11, and then bends and extends reversely backward to pass beyond a vertical plane on which the first base 11 is located. A first contact portion 13 extends backward from each first elastic portions 12. The first contact portion 13 extends upward out of the corresponding accommodating hole 41. The first contact portion 13 is in an arc shape, and upward abuts the mating component 200. The first contact portion 13 extends downward to form a first free portion 15. As shown in FIG. 4 and FIG. 5, the first elastic portion 12 has a first shielding portion 122, and a first extending portion 121 extending leftward from the first shielding portion 122. The left side of the first extending portion 121 is flush with the left side of the first contact portion 13. The first contact portion 13 forms a first notch 14 at a side (i.e., right side) close to the first shielding portion 122, and the first notch 14 extends forward to the first shielding portion 122, such that the width of the first contact portion 13 is less than the width of the first elastic portion 12.

Figure 7:
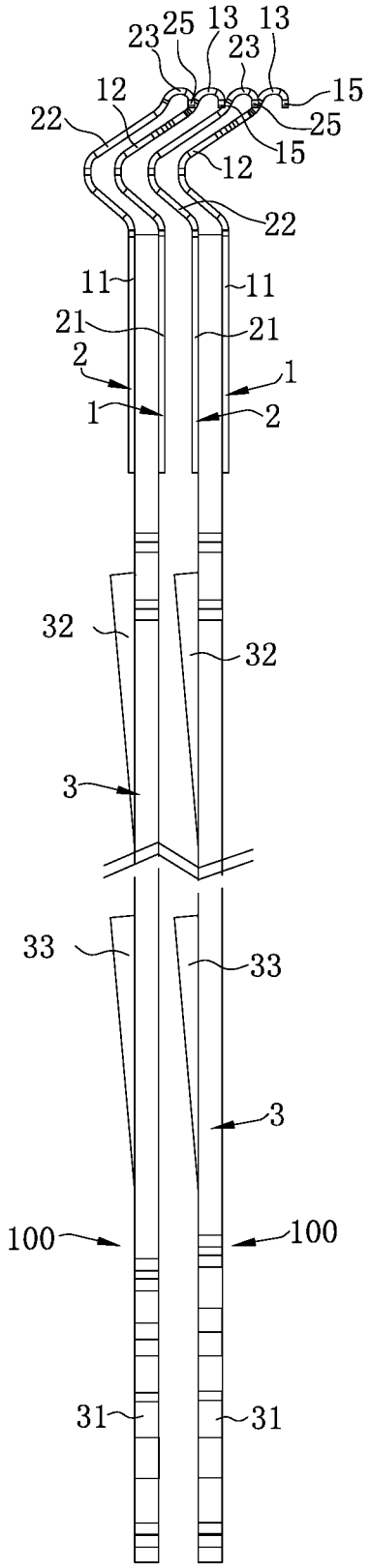
FIG. 7 is a right side view of FIG. 2.

As shown in FIG. 2 and FIG. 3, the second terminal 2 has a second base 21 located in front of the first base 11 and attached to a front side of the metal plate 3. The second base 21 is provided with two second positioning holes 211 corresponding to the first positioning holes 111. Multiple second elastic portions 22 bend and extend upward from the second base 21 and are arranged in a row in the left-right direction. In other embodiments, the second terminal 2 may also be provided with only one second elastic portion 22. The second elastic portion 22 and the first elastic portion 12 are in parallel, and in other embodiments, they may be provided not to be in parallel. As shown in FIG. 5, a distance M1 between the left side of the leftmost first elastic portion 12 and the left side of the metal plate 3 is less than a distance M2 between the left side of the leftmost second elastic portion 22 and the left side of the metal plate 3. That is, the left side of the leftmost first elastic portion 12 is closer to the left side of the metal plate 3 than the left side of the leftmost second elastic portion 22. A distance N1 between the right side of the rightmost second elastic portion 22 and the right side of the metal plate 3 is less than a distance N2 between the right side of the rightmost first elastic portion 12 and the right side of the metal plate 3. That is, the right side of the rightmost second elastic portion 22 is closer to the right side of the metal plate 3 than the right side of the rightmost first elastic portion 12. A second contact portion 23 extends backward from each second elastic portion 22. The second contact portion 23 is located in front of the first contact portion 13, and the second contact portion 23 extends upward out of the corresponding accommodating hole 41. The second contact portion 23 is in an arc shape, and upward abuts the mating component 200. The second contact portion 23 is located between two adjacent first elastic portions 12 in a vertical direction. That is, the second contact portion 23 does not overlap with the first elastic portion 12 in the vertical direction. As shown in FIG. 7, the second contact portion 23 extends downward to form a second free portion 25, and the second free portion 25 overlaps with the first elastic portions 12 in the left-right direction. That is, the lowest point of the second free portion 25 is lower than the highest point of each first elastic portion 12. As shown in FIG. 2, FIG. 4 and FIG. 5, the first elastic portions 12 and the second elastic portions 22 are partially overlapped in the front-rear direction. In other embodiments, the first elastic portion 12 and the second elastic portion 22 may also be completely overlapped in the front-rear direction. Each second elastic portion 22 has a second shielding portion 222 extending upward from the second base 21 and a second extending portion 221 formed by extending rightward from the second shielding portion 222. The second shielding portion 222 overlaps with the first shielding portion 122 in the front-rear direction. That is, the second shielding portion 222 shields the first shielding portion 122 backward. The first extending portion 121 does not overlap with the second elastic portion 22 in the front-rear direction, and is located between two adjacent second elastic portions 22. The second extending portion 221 does not overlap with the first elastic portion 12 in the front-rear direction, and is located between two adjacent first elastic portions 12. The right side of the second extending portion 221 is flush with the right side of the second contact portion 23. The second contact portion 23 forms a second notch 24 on a side (i.e., left side) close to the second shielding portion 222, and the second notch 24 extends forward to the second shielding portion 222, such that the width of the second contact portion 23 is less than the width of the second elastic portion 22.

As shown in FIG. 4, FIG. 5 and FIG. 8, the first terminal 1 and the adjacent second terminal 2 accommodated in the two accommodating holes 41 spaced apart (that is, the first terminal 1 of the terminal set 100 at the front and the second terminal 2 of the terminal set 100 at the back, the first terminal 1 being referred to as a front terminal, and the second terminal 2 being referred to as a rear terminal) are not electrically connected to each other. The first shielding portion 122 of the first terminal 1 shields the corresponding second elastic portion 22 of the second terminal 2 backward in the front-rear direction. That is, the first elastic portion 12 of the first terminal 1 and the corresponding second elastic portion 22 of the second terminal 2 are partially overlapped. In other embodiments, the first elastic portion 12 of the first terminal 1 and the second elastic portion 22 of the second terminal 2 may be completely overlapped. The first elastic portion 12 shields a portion of the corresponding second elastic portion 22 downward in the vertical direction, and the first contact portion 13 is located between the two adjacent second elastic portions 22. The first free portion 15 overlaps with the second elastic portion 22 in the left-right direction.

Figure 9:
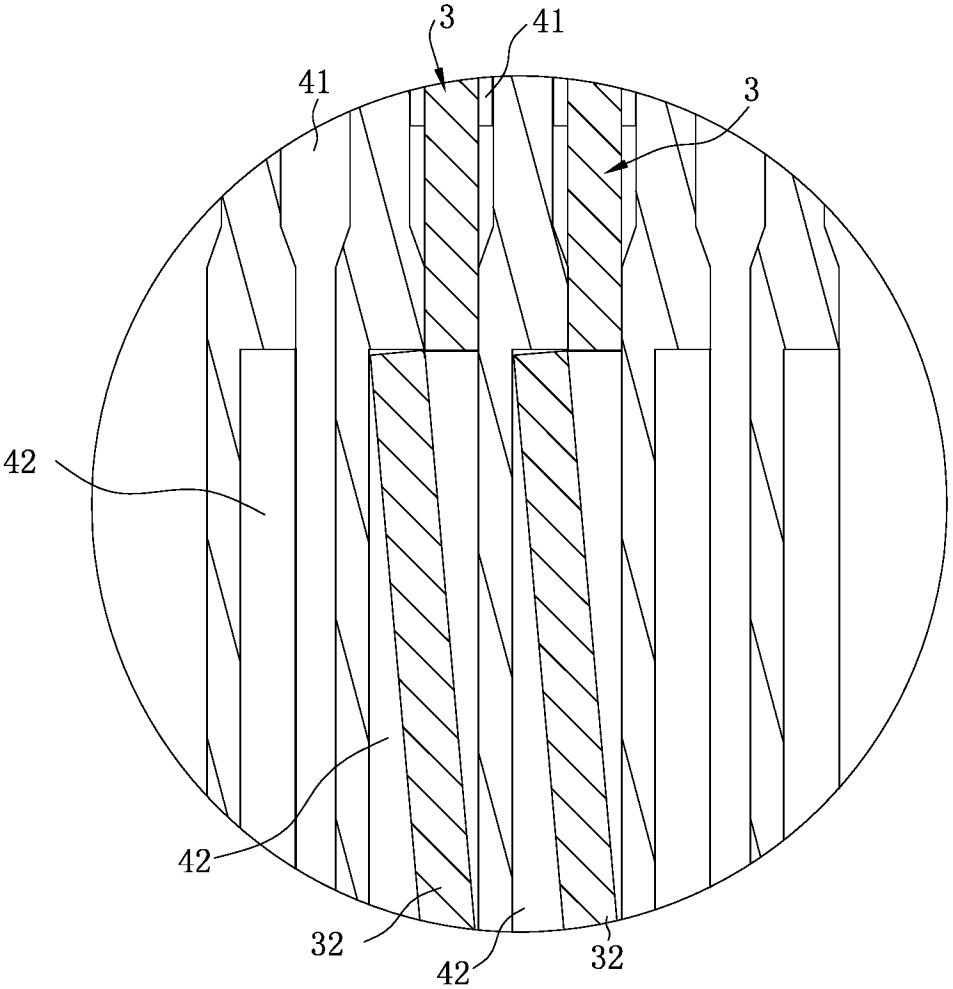
FIG. 9 is an enlarged view of position D of FIG. 8.

As shown in FIG. 2 and FIG. 3, the metal plate 3 is provided with third positioning holes 34 corresponding to the first positioning holes 111 and the second positioning holes 211. The first terminal 1 and the second terminal 2 are fixed to the front side and the rear side of the metal plate 3 by laser processes. The metal plate 3 is placed on an assembly jig (not shown) having two positioning posts, and the positioning posts (not shown) match with the third positioning holes 34 to prevent the metal plate 3 from swinging. The first terminal 1 is attached to the surface of the metal plate 3, and the positioning posts (not shown) pass through the third positioning holes 34 of the metal plate 3 to match with the first positioning holes 111 of the first terminal 1, so as to prevent the first terminal 1 from swinging relative to the metal plate 3. Then, laser welding is performed. The assembly of the second terminal 2 to the metal plate 3 adopts the same method as that in assembly of the first terminal 1 to the metal plate 3. The metal plate 3 is provided with two insertion portions 31 (and in other embodiments, the quantity of the insertion portions 31 may also be one or three or even more) to be inserted to a circuit board 300. In this embodiment, the insertion portions 31 are fisheye-shaped. In the left-right direction, one insertion portion 31 is provided near a side edge of the metal plate 3, and the other insertion portion 31 is provided near the center of the metal plate 3. The insertion portions 31 of the two metal plates 3 in the two accommodating holes 41 adjacent to each other in the front-rear direction are staggered. The metal plate 3 is provided with a pair of first position limiting sheets 32 and a pair of second position limiting sheets 33. The first position limiting sheets 32 are provided on an upper portion of the metal plate 3, and the second position limiting sheets 33 are located on a lower portion of the metal plate 3. In the left-right direction, the first position limiting sheets 32 and the second position limiting sheets 33 are staggered, and the first position limiting sheets 32 are located closer to left and right side edges of the metal plate 3 than the second position limiting sheets 33. As shown in FIG. 8 and FIG. 9, the first position limiting sheets 32 match with the first position limiting slots 42, and the second position limiting sheets 33 match with the second position limiting slots 43 to limit the metal plate 3 from being detached from the insulating body 4. The terminal sets 100 according to the embodiments of the present invention may include current terminals or signal terminals. As shown in FIG. 2 and FIG. 3, when the first terminal 1 and the second terminal 2 are power terminals, the electrical conductivity of the metal plate 3 is higher than the electrical conductivities of the first terminal 1 and the second terminal 2. In general, the metal plate 3, the first terminal 1 and the second terminal 2 are all made of copper materials, and with a higher electrical conductivity, a large current may be more favorably conducted. Considering that the first terminal 1 and the second terminal 2 are elastic structures, it is not suitable to use a material with high purity, and they can be made of C7025 copper, of which the electrical conductivity is generally 45%. The metal plate 3 is a flat plate structure and is relatively easy to form. It can be made of C110 copper with higher purity, of which the electrical conductivity is generally 90%. Due to the presence of the metal plate 3, the heat generation is lower and the current that can be carried is larger with the premise of conducting the same current in comparison to the case where no metal plate is provided. Moreover, for the current terminals, more first elastic portions 12 and second elastic portions 22 can be arranged according to the embodiments of the present invention, such that the quantities of the first contact portions 13 and the second contact portions 23 are correspondingly increased, and the contact points of the terminal set 100 in contact with the mating component 200 are increased. Thus, temperature rise and heat generation are reduced, and a larger current can be conducted.

For the signal terminals, more terminal sets 100 can be arranged according to the embodiments of the present invention, such that the density of the terminal sets 100 can be increased, allowing more terminal sets 100 to be electrically connected to the mating component 200, and more signals can be transmitted at the same time.

To sum up, the terminal set 100 and the electrical connector using the terminal set 100 according to certain embodiments of the present invention have the following beneficial effects:

1. The first elastic portion 12 of the first terminal 1 and the second elastic portion 22 of the second terminal 2 at least partially overlap in the front-rear direction. Compared to the case where the first elastic portion 12 and the second elastic portion 22 are spaced apart in the front-rear direction, the distance between the first elastic portion 12 and the second elastic portion 22 in the left-right direction can be reduced. Meanwhile, the second contact portion 23 is located between the adjacent two first elastic portions 12 in the vertical direction. Thus, the second contact portion 23 does not overlap with the first elastic portion 12 in the vertical direction, thereby preventing the second contact portion 23 from abutting the first elastic portion 12 downward when the mating component 200 presses downward on the second contact portion 23, and ensuring good contact between the mating component 200 and the second contact portion 23. Meanwhile, the distance between the first terminal 1 and the second terminal 2 in the front-rear direction can be reduced, thereby enhancing the density of the terminal set 100, and increasing contact points of the terminal set 100 in contact with the mating component 200 in a limited space.

2. The first contact portion 13 forms a first notch 14 on a side close to the first shielding portion 122, and the first notch 14 extends to the first shielding portion 122. The second contact portion 23 forms a second notch 24 on a side close to the second shielding portion 222, and the second notch 24 extends to the second shielding portion 222. Thus, the widths of the first elastic portion 12 and the second elastic portion 22 are satisfied, ensuring the strengths of the first elastic portion 12 and the second elastic portion 22, and the widths of the first contact portion 13 and the second contact portion 23 are also reduced, thereby reducing the distance between the first contact portion 13 and the second contact portion 23 in the left-right direction. Therefore, the widths of the first elastic portion 12 and the second elastic portion 22 that facilitate overlapping in the front-rear direction are larger, such that the first elastic portions 12 and the second elastic portions 22 can be arranged more closely in the left-right direction, and more first elastic portions 12 and second elastic portions 22 can be arranged in a limited space, thereby further increasing the quantities of the first contact portions 13 and the second contact portions 23 to abut the mating component 200.

3. The second free portion 25 overlaps with the first elastic portions 12 in the left-right direction, such that the distance between the first terminal 1 and the second terminal 2 in the front-rear direction can be reduced, thereby enhancing the density of the first terminal 1 and the second terminal 2, and further enhancing the density of the terminal set 100 in the front-rear direction.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments were chosen and described in order to explain the principles of the invention and their practical application so as to activate others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims rather than the foregoing description and the exemplary embodiments described therein.

What is claimed is:

1. A terminal set, configured to be electrically connected to a mating component, comprising:

a first terminal, having a first base, a plurality of first elastic portions extending upward from the first base and arranged in a row in a left-right direction, and a first contact portion extending backward from the first elastic portions; and a second terminal formed separately from the first terminal, wherein the first terminal and the second terminal are electrically connected to each other, the second terminal has a second base located in front of the first base, a plurality of second elastic portions extending upward from the second base and arranged in a row in the left-right direction, a second contact portion extending backward from the second elastic portions and located in front of the first contact portion, and the first contact portion and the second contact portion are configured to upward abut the mating component;

wherein the second contact portion is located between two adjacent ones of the first elastic portions in a vertical direction; and the second elastic portions shield at least a portion of the corresponding first elastic portions backward in a front-rear direction.

2. The terminal set according to claim 1, wherein the second elastic portions shield a portion of the corresponding first elastic portions downward in the vertical direction.

3. The terminal set according to claim 1, wherein each of the first elastic portions has a first shielding portion and a first extending portion protruding from the first shielding portion in a width direction, each of the second elastic portions has a second shielding portion and a second extending portion protruding from the second shielding portion in the width direction, the second shielding portion shields the first shielding portion backward in the front-rear direction, the second extending portion is located between the two adjacent ones of the first elastic portions, and the first extending portion is located between two adjacent ones of the second elastic portions.

4. The terminal set according to claim 3, wherein the first contact portion forms a first notch at a side close to the first shielding portion, the first notch extends forward to the first shielding portion, the second contact portion forms a second notch at a side close to the second shielding portion, and the second notch extends forward to the second shielding portion.

5. The terminal set according to claim 3, wherein one side of the first extending portion is flush with one side of the first contact portion.

6. The terminal set according to claim 1, further comprising a metal plate, wherein the first terminal and the second terminal are both power terminals, an electrical conductivity of the metal plate is higher than electrical conductivities of the first terminal and the second terminal, and the first base and the second base are fixed to a front side and a rear side of the metal plate.

7. The terminal set according to claim 1, wherein the second contact portion extends downward to form a free portion, and the free portion is provided to overlap with a corresponding one of the first elastic portions in the left-right direction.

8. An electrical connector, comprising:

an insulating body;

a rear terminal, accommodated in the insulating body, wherein the rear terminal has a rear base, at least one rear elastic portion extending upward from the rear base, and a rear contact portion extending backward from the rear elastic portion; and a front terminal, accommodated in the insulating body and separately formed from the rear terminal, wherein the front terminal has a front base located in front of the rear base, at least one front elastic portion extending upward from the front base, and a front contact portion extending backward from the front elastic portion and located in front of the rear contact portion, and the front contact portion and the rear contact portion are configured to upward abut a mating component;

wherein the front elastic portion and the rear elastic portion are provided to be at least partially overlapped in a front-rear direction, and the front contact portion does not overlap with the rear elastic portion in a vertical direction.

9. The electrical connector according to claim 8, wherein the front elastic portion has a shielding portion and an extending portion protruding from the shielding portion in a width direction, the shielding portion overlaps with the rear elastic portion in the front-rear direction, and the extending portion does not overlap with the rear elastic portion in the front-rear direction.

10. The electrical connector according to claim 9, wherein the front contact portion forms a notch at a side close to the shielding portion, and the notch extends forward to the shielding portion.

11. The electrical connector according to claim 8, wherein the insulating body is provided with a plurality of accommodating holes running vertically through the insulating body, and the front terminal and the rear terminal are accommodated in two of the accommodating holes spaced apart and are not electrically connected to each other.

12. The electrical connector according to claim 8, wherein the insulating body is provided with an accommodating hole running vertically through the insulating body, and the front terminal and the rear terminal are accommodated in the same accommodating hole and are electrically connected to each other.

13. The electrical connector according to claim 12, wherein the front base and the rear base accommodated in the same accommodating hole are fixed to a front side and a rear side of a metal plate, the front terminal and the rear terminal are both power terminals, and an electrical conductivity of the metal plate is higher than electrical conductivities of the front terminal and the rear terminal.

14. The electrical connector according to claim 11, wherein the two of the accommodating holes accommodate two metal plates, one of the two metal plates fixes the front terminal, the other of the two metal plates fixes the rear terminal, each of the metal plates has an insertion portion, and the insertion portions of the two metal plates are staggered in the front-rear direction.

15. The electrical connector according to claim 8, wherein the front elastic portion shields a portion of the rear elastic portion downward in the vertical direction.

16. The electrical connector according to claim 8, wherein the front contact portion extends downward to form a free portion, and the free portion is provided to overlap with the corresponding rear elastic portion in a left-right direction.

* * * * *